US006440003B1

(12) United States Patent
Phillips et al.

(10) Patent No.: US 6,440,003 B1
(45) Date of Patent: Aug. 27, 2002

(54) BALL FEEDER AND METHOD

(76) Inventors: James C. Phillips, 1595 Oak St., High Point, NC (US) 27265; Ronald Hermans, 506 Jarrell Rd., Lexington, NC (US) 27292

( * ) Notice: Subject to any disclaimer, the term of this patent is extended or adjusted under 35 U.S.C. 154(b) by 0 days.

(21) Appl. No.: 09/839,089

(22) Filed: Apr. 23, 2001

(51) Int. Cl.[7] ..... A63B 69/36
(52) U.S. Cl. ..... 473/137
(58) Field of Search ..... 473/132–137

(56) References Cited

U.S. PATENT DOCUMENTS 2,171,299 A * 8/1939 Beckett ..... 473/137
5,022,657 A * 6/1991 Bussiere et al. ..... 473/137
5,580,318 A * 12/1996 Weber ..... 473/137
5,582,325 A * 12/1996 Janier ..... 473/137

OTHER PUBLICATIONS

Range Land USA—The Automatic Golf Tee flier one page (undated).
American Range Co.—ARC–EZ Tee flier one page (undated).
Golf Dreams—Computer Caddy flier one page (undated).

* cited by examiner

*Primary Examiner*—Steven Wong

(57) ABSTRACT

A ball feeder and method is presented for loading a tee for use at golf driving ranges or the like. The feeder includes a pivotal hopper which has been filled with golf balls with a hinged chute connected thereto. By manually pivoting the hopper rearwardly, the chute is raised from a base into alignment with the tee as a ball is delivered into the chute for direction to the tee. Upon release, the hopper then pivots forwardly towards the tee and allows the chute to return to its dormant position. An agitator which is connected to the base prevents ball jams within the hopper by turning during the pivoting motion of the hopper.

19 Claims, 3 Drawing Sheets

BALL FEEDER AND METHOD

FIELD OF THE INVENTION

The invention herein pertains to ball feeding devices and particularly to devices and methods for dispensing a golf ball onto a tee for practice driving.

DESCRIPTION OF THE PRIOR ART AND OBJECTIVES OF THE INVENTION

Many golfing enthusiasts spend time at driving ranges hitting practice balls to improve their driving distance and accuracy. While most golfers enjoy swinging a golf club, loading the tee can be both tiresome and a detraction from an otherwise pleasant driving range experience. Thus, various ideas have been conceived in the past for automatically loading golf tees for driving practice purposes. Certain of the prior art devices are electrically powered and can cost thousands of dollars. Other devices are mechanically operated and are less expensive but may be less precise in their loading action, causing the ball to miss the tee. Other mechanical devices tend to malfunction and frequently jam, resulting in the golfer losing the rhythm of his swing.

Thus with the known problems and disadvantages of prior art golf ball feeders and methods, the present invention was conceived and one of its objectives is to provide a ball feeder which will actively and dependently deliver a golf ball to a tee.

It is yet another objective of the present invention to provide a ball feeder and method of operation which has a manually operated pivotal hopper.

It is yet another objective of the present invention to provide a ball feeder which includes a hopper agitator to prevent ball jamming.

It is yet another objective of the present invention to provide a ball feeder which has an adjustment member for limiting the pivoting motion of the hopper.

It is still a further objective of the present invention to provide ball feeder which includes an enclosed chute having proximal and distal sections which raise and axially align during feeding the ball to the tee.

Various other objectives and advantages of the present invention will become apparent to those skilled in the art as a more detailed description is set forth below.

SUMMARY OF THE INVENTION

A ball feeder and method allows golf balls to be quickly and efficiently deposited on a tee positioned on the elongated base of the feeder. The feeder also has a hopper which is attached to an L-shaped proximal section of an enclosed, tubular chute. The L-shaped chute section is pivotally joined to the elongated base and at its terminal end, a hinge is affixed for connecting the chute distal section. The distal section is linear and includes an arcuate ball catch at its free end for guiding the ball onto the tee. The distal section which is normally within a channel of the base below the top of the tee rises from the base channel through its hinged connection with the proximal section of the chute when the hopper is pivoted rearwardly, away from the tee to load the tee with a ball, as the ball passes through the distal section. The proximal section of the chute thus lifts the distal section into axial alignment therewith. Such axial alignment allows a ball from the hopper to then pass through the proximal and distal chute sections by gravity. The arcuate catch on the free end of the distal section guides the ball onto the tee as it exits therefrom. When the hopper is released it swings forwardly, allowing the proximal and distal chute sections to hingedly separate and misalign while the distal section moves to its lower, dormant posture within the channel of the base, providing an unobstructed tee with the ball positioned thereon. A golfer can then strike the teed ball with a club as usual. thereafter, by pushing a tab on the hopper with, for example, the golf club, the hopper will again pivot rearwardly and the ball feeding method begins anew. To limit the pivoting action of the hopper, a threaded adjustment member is provided at the rear of the base which is struck by the proximal section of the chute as it and the hopper pivot rearwardly. The adjustment member allows for tees of different heights to be acurately loaded with golf balls. An agitator positioned in the hopper turns as the hopper pivots to prevent ball jams occurring therein.

DETAILED DESCRIPTION OF THE PREFERRED EMBODIMENTS AND OPERATION OF THE INVENTION

Figure 1:
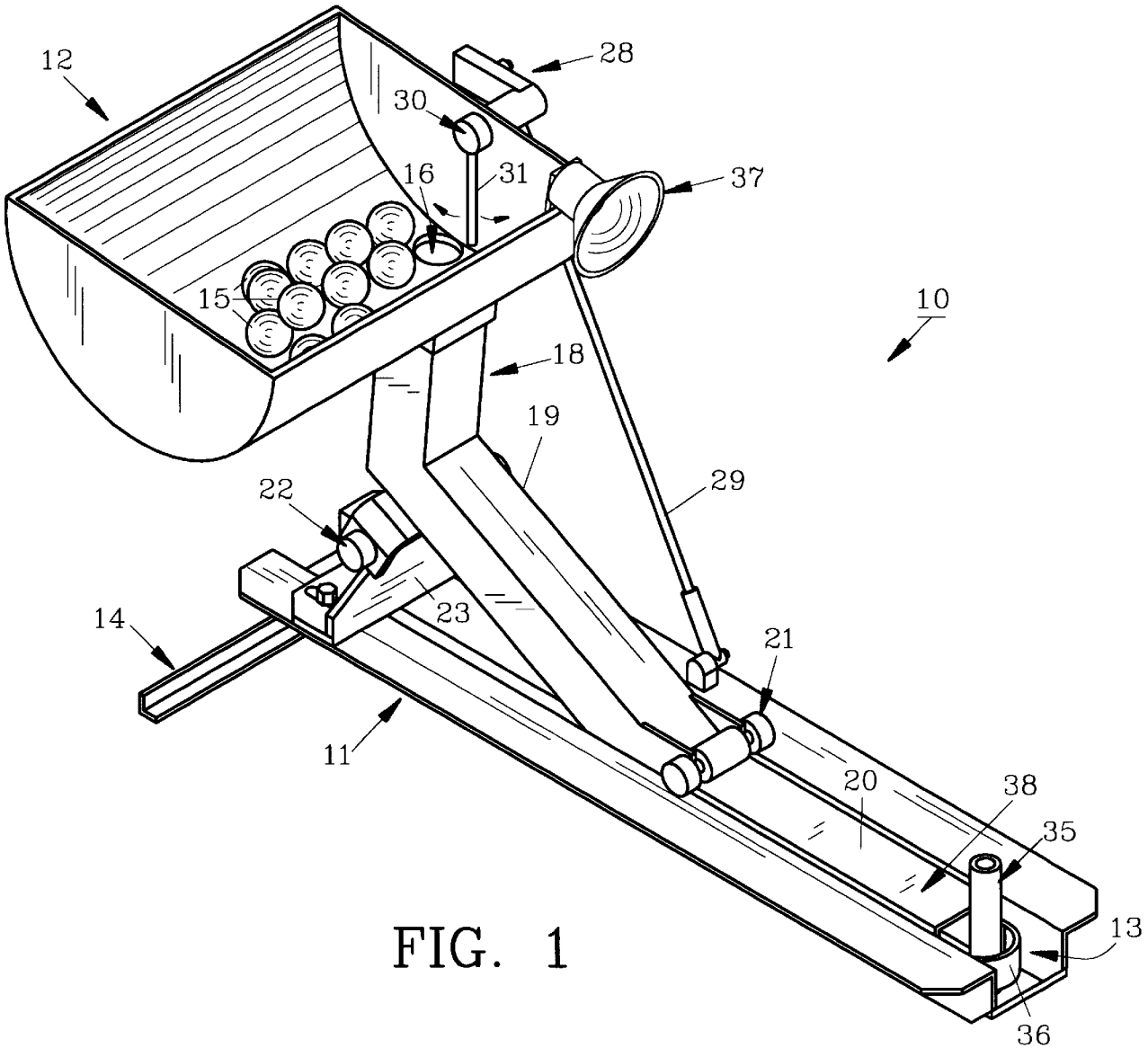
FIG. 1 shows a perspective view of the preferred embodiment of the ball feeder in its normal or "at rest" position.

For a better understanding of the invention and its operation, turning now to the drawings, FIG. 1 illustrates preferred ball feeder 10 having an elongated base 11 and a hopper 12 for maintaining golf balls 15. Lateral base stabilizer 14 is attached to base 11 for stability purposes. Hopper 12 may hold for example, one hundred golf balls 15 which are gravity fed through aperture 16 which is in communication with L-shaped proximal section 19 of ball chute 18. Chute 18 includes LShaped proximal section 19 and linear distal section 20, seen resting in central channel 13 of base 11. Hinge 21 connects chute proximal section 19 and distal section 20. As further seen in FIG. 1, proximal section 19 and distal section 20 are misaligned along their longitudinal axes and balls 15 contained in proximal section 19 will not roll into distal section 20 in this dormant or "at rest" posture. Hinge 22 is also shown in FIG. 1 affixed to flange 23 which is adjustably joined to base 11. Flange 23 is slidably attached to base 11 along the longitudinal axis of base 11. Hinge 22 allows hopper 12 to pivot during ball feeding as hopper 12 is rigidly connected to proximal section 19. Threaded adjustment member 24 shown in FIG. 2 is also affixed to the base of flange 23 and terminates the rearward pivoting motion of hopper 12 as explained in more detail below.

Balls 15 in hopper 12 shown in FIG. 1 may jam during entry into aperture 16 and to prevent such malfunctions, agitator 28 is provided. Agitator 28 includes linkage 29 which is affixed to base 11 and to lever 30. Lever 30 is pivotally positioned on hopper 12 and drives agitator blade 31 as seen in FIG. 1. As hopper 12 rotates, agitator blade 31 turns to dislodge balls 15 jammed near aperture 16 within hopper 12.

Figure 2:
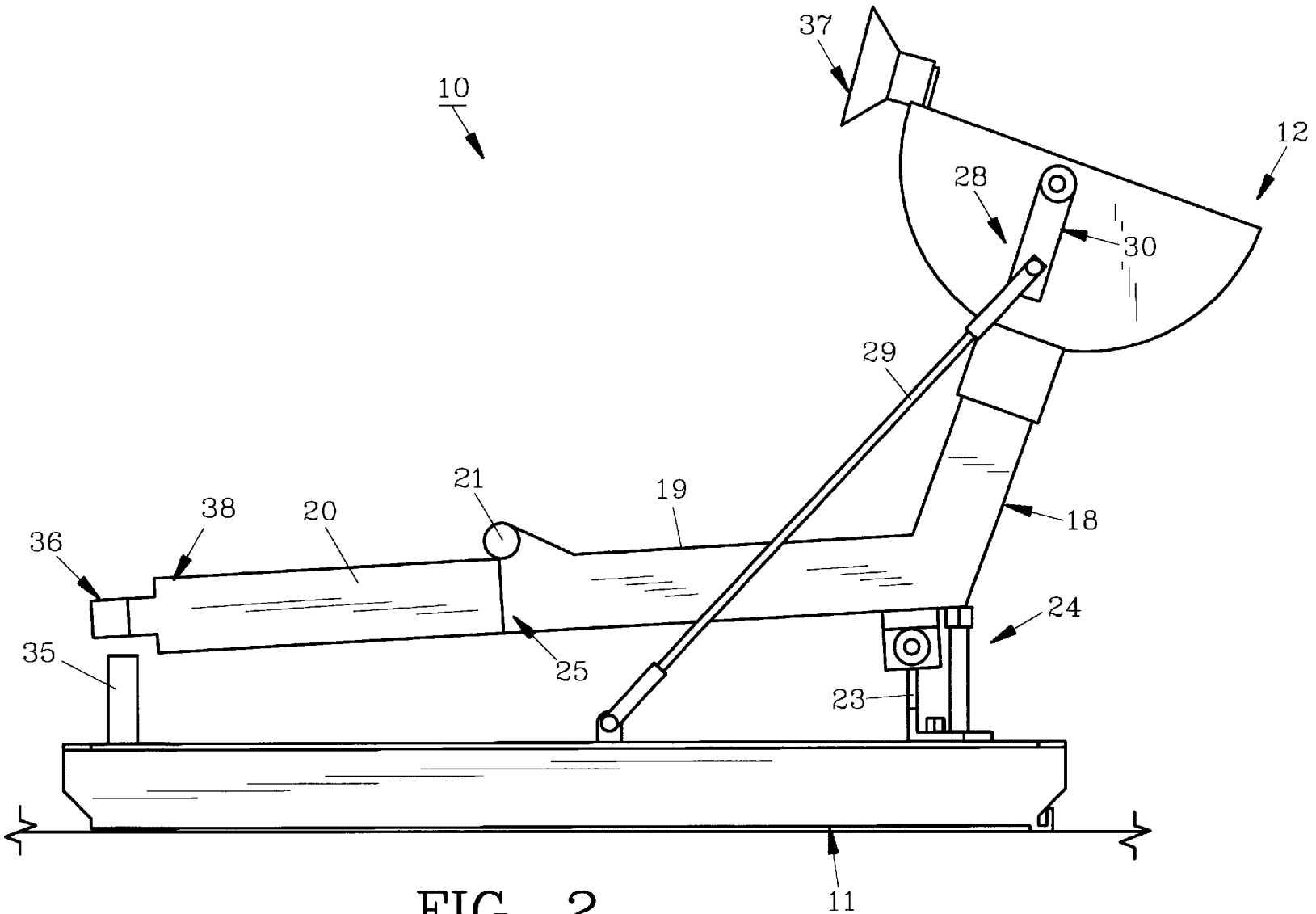
FIG. 2 illustrates a side view of the ball feeder as seen in FIG. 1 but in a posture with the hopper pivoted rearwardly as the ball is loaded onto the tee.

In FIG. 2 hopper 12 is shown in a rearward (loading) position with chute proximal section 19 axially aligned with distal section 20 (raised from channel 13) to allow a ball 15 to roll therethrough onto tee 35. After alignment for ball feeding as shown in FIG. 2, hopper 12 returns to its normal or forward position and distal section 20 lowers into channel 13 of base 11, below tee 35, illustrated in FIG. 3. As seen, golf ball 15 on tee 35 is now unobstructed and can be readily driven by a golfer during practice. Tee 35 attached to base 11 can be replaced with a taller or shorter tee and adjustment member 24 is vertically regulated accordingly so ball catch 36 aligns correctly with the desired tee height. Adjustment member 24 is slightly lowered for taller tees and slightly raised for shorter tees so catch 36 surrounds the top area of tee 35 (FIG. 2) and the bottom of distal section 20 coincides therewith to insure correct ball 15 positioning thereon.

Figure 3:
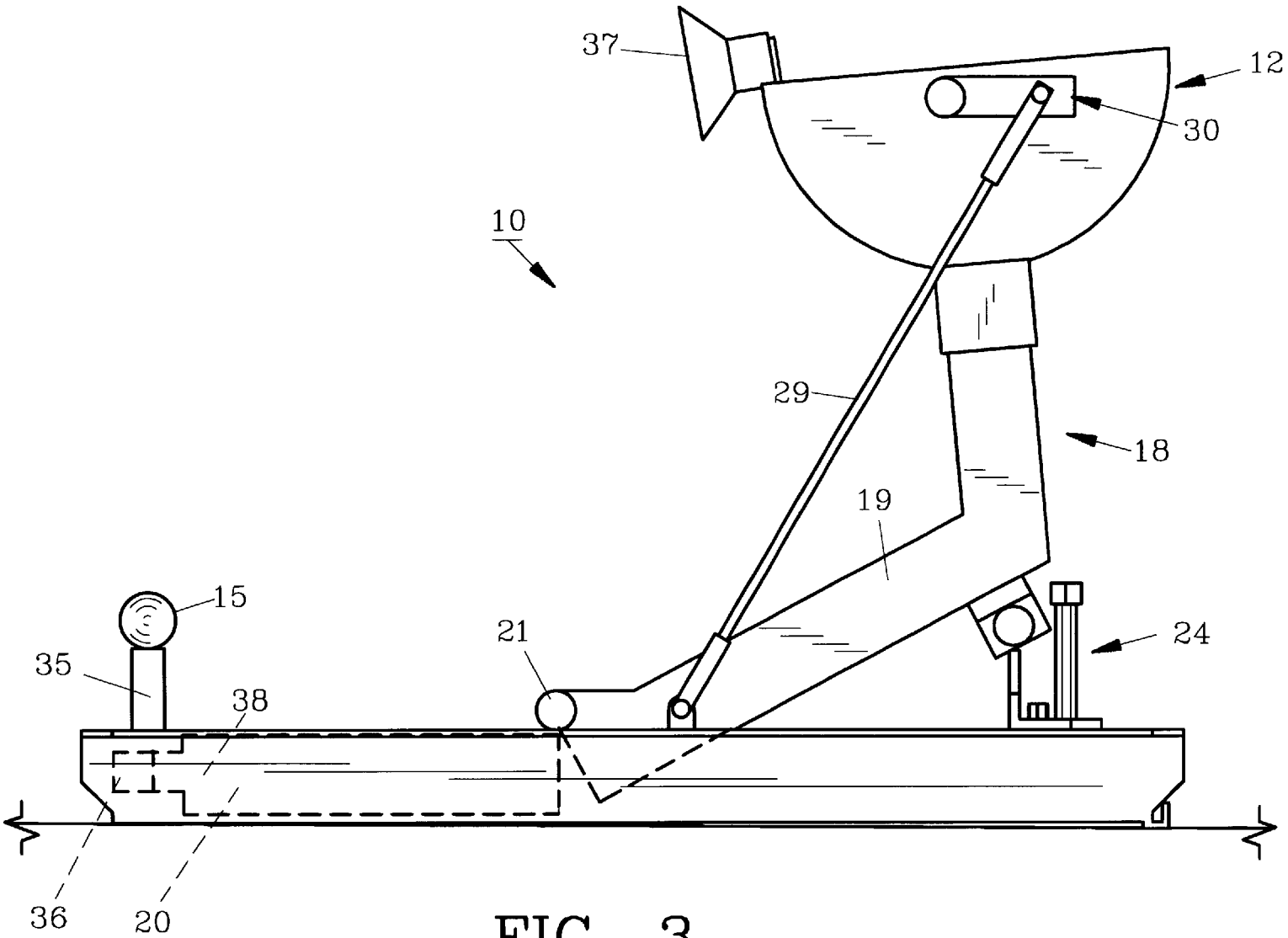
FIG. 3 depicts a side view of the ball feeder with the ball loaded onto the tee with the hopper returned to its normal position.

The preferred method of feeding golf balls to a tee for practice swinging at a driving range or other location includes the steps of first placing golf ball feeder 10 on a solid, level surface such as the ground or the like. Next, a plurality of golf balls 15 are then placed within hopper 12. A golfer (not shown) standing near tee 35 then pushes saucer shaped tab 37 which is rigidly affixed to hopper 12 in a rearward direction. Hopper 12 will then pivot (rearwardly) as shown in FIG. 2 causing a golf ball 15 contained within hopper 12 to fall through aperture 16, or a ball 15 which has stopped at proximal section end 25 near hinge 21, to roll through chute distal section 20 as proximal section 19 axially aligns therewith. Ball 15 will continue to roll by gravity through distal section 20 and with the guidance of arcuate catch 36, will terminate its movement atop tee 35. Should ball 15 not properly be deposited on tee 35, adjustment member 24 can be turned for raising or lowering distal free end 38 to insure catch 36 and distal section 20 are raised sufficiently and align correctly with the top of tee 35. Upon releasing tab 37, hopper 12 immediately pivots forwardly (by force of gravity) in the direction of tee 35, whereby proximal section 19 and distal section 20 again misalign and separate at hinge 21 as each section reverts to its dormant or lowered position. Such misalignment prevents ball movement from proximal section 19 to distal section 20. As shown in FIG. 3, tee 35 now with golf ball 15 thereon, is unobstructed as catch 36 has withdrawn within channel 13 of base 11 and golf ball 15 can be driven as usual.

The illustrations and examples provided herein are for explanatory purposes and are not intended to limit the scope of the appended claims.

We claim:

1. A ball feeder comprising: a base, a hopper, an enclosed chute, said chute joined to said hopper for receiving balls therefrom, said chute comprising proximal and distal sections, said proximal section pivotally joined to said base, said proximal section in communication with said hopper, a tee, said tee positioned proximate said base whereby pivoting said hopper will cause a ball contained therein to be directed through said proximal and distal sections of said chute for deposit on said tee.

2. The ball feeder of claim 1 wherein said proximal section is L-shaped.

3. The ball feeder of claim 1 wherein said proximal section is hingedly joined to said distal section.

4. The ball feeder of claim 1 further comprising a catch, said catch attached to said distal section, said catch for guiding said ball onto said tee.

5. The ball feeder of claim 1 wherein said enclosed chute comprises a tubular member.

6. The ball feeder of claim 1 further comprising a tab, said tab attached to said hopper to facilitate manual pivoting thereof.

7. The ball feeder of claim 1 further comprising an adjustment member, said adjustment member attached to said base, said adjustment member for limiting the pivot motion of said hopper.

8. The ball feeder of claim 1 further comprising an agitator, said agitator mounted on said hopper for stirring balls therein.

9. The ball feeder of claim 8 wherein said agitator comprises an adjustable blade, a lever, said blade attached to said lever.

10. A ball feeder comprising: a base, a pivotal hopper, a chute, said chute pivotally joined to said base, said chute comprising a proximal and a distal section, said proximal section joined to said hopper for receiving balls therefrom, said proximal section hingedly joined to said distal section whereby pivoting said hopper will cause said distal section to raise into axial alignment with said proximal section for receiving balls therefrom.

11. The ball feeder of claim 10 further comprising an agitator, said agitator mounted on said hopper for stirring balls therein.

12. The ball feeder of claim 10 further comprising an adjustment member, said adjustment member attached to said base for limiting the pivotal motion of said hopper.

13. The ball feeder of claim 10 wherein said proximal section is L-shaped.

14. The ball feeder of claim 10 wherein said chute is enclosed.

15. A method of placing a ball on a tee with a ball feeder having a pivotal hopper and a chute with proximal and distal sections hingedly connected, comprising the steps of:

a) placing a ball in the hopper;

b) pivoting the hopper to allow the ball to pass through said proximal and distal chute sections; and c) delivering the ball to the tee by said distal section.

16. The method of claim 15 wherein placing a ball in the hopper comprises the step of placing a golf ball in the hopper.

17. The method of claim 15 wherein pivoting the hopper comprises the step of manually pivoting the hopper.

18. The method of claim 15 wherein pivoting the hopper comprises. the step of raising said proximal and distal sections to axially align said proximal section with said distal section and to align said distal section with said tee.

19. The method of claim 15 wherein delivering the ball to the tee comprises the step of raising the distal section to the top of the tee as said hopper pivots.

* * * * *